US006309433B1

(12) United States Patent
Kinoshita

(10) Patent No.: US 6,309,433 B1
(45) Date of Patent: Oct. 30, 2001

(54) POLISHING PAD CONDITIONER FOR SEMICONDUCTOR SUBSTRATE

(75) Inventor: Toshiya Kinoshita, Kawasaki (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/363,714

(22) Filed: Jul. 29, 1999

(30) Foreign Application Priority Data

Jul. 31, 1998 (JP) ..... 10-216658
May 19, 1999 (JP) ..... 11-138513

(51) Int. Cl.[7] ..... B24B 53/00
(52) U.S. Cl. ..... 51/307; 51/295; 51/309
(58) Field of Search ..... 51/295, 307, 309

(56) References Cited

U.S. PATENT DOCUMENTS 4,239,502 * 12/1980 Slack et al. ..... 51/295
4,448,605 * 5/1984 Mizuhara ..... 75/213 H
4,968,326 * 11/1990 Wiand ..... 51/309
5,385,591 * 1/1995 Ramanath et al. ..... 51/309
5,492,771 * 2/1996 Lowder et al. ..... 428/565

* cited by examiner

*Primary Examiner*—Archene Turner
(74) *Attorney, Agent, or Firm*—Kenyon & Kenyon

(57) ABSTRACT

There is provided a conditioner which eliminates loading of a polishing pad, stabilizes polishing speeds and has a long usable life in metal CMP employing acidic slurry, which allows production of semiconductors at high quality and high yield, and which is characterized in that diamond grains are supported by monolayer brazing in a supporting material comprising a metal and/or alloy, using an alloy with a melting point of 600–1200° C. which contains 0.5–20 wt % of at least one metal selected from among titanium, zirconium and chromium and 30–99.5 wt % of at least one metal selected from among gold, platinum and silver.

5 Claims, No Drawings

POLISHING PAD CONDITIONER FOR SEMICONDUCTOR SUBSTRATE

TECHNICAL FIELD

The present invention relates to a conditioner used to eliminate loading of a polishing pad in flat polishing processes for a semiconductor substrate in metal CMP (Chemical Mechanical Planarization) employing acidic slurry.

BACKGROUND ART

Polishing of semiconductor wafers requires a polishing method which ensures the necessary polishing speed while preventing defects such as mechanical warping. In conventional mechanical polishing methods, the polishing speed can be ensured by increasing the size of the abrasive grits or the applied polishing load. However, because polishing results in various defects, it has been difficult to both ensure polishing speed and keep polishing targets defect-free. One method that has been proposed is known as chemical mechanical planarization (CMP). This method takes advantage of a chemical polishing action in addition to a mechanical polishing action, making it possible to both guarantee polishing speed and obtain defect-free polishing targets. With the higher integration of devices in recent years, CMP polishing of surfaces of semiconductor substrates having conductive metal layers formed on wafer surfaces has become important at certain stages in the production of integrated circuits.

One example of a metal CMP process is one that uses a polishing pad comprising a polyurethane resin, and a chemical slurry containing alumina particles as abrasive grits and iron nitrate as an oxidizing agent and prepared to have a pH of about 1.5 with nitric acid. For polishing, a semiconductor substrate is contacted with the polishing pad while circulating chemical slurry so that polishing is accomplished by relative rotation. Because the polishing speed is reduced at this time due to loading of the polishing pad, conditioning of the polishing pad is essential. Conditioning of a polishing pad has conventionally been accomplished by running water or chemical slurry over the polishing pad while a conditioner with nickel electrodeposited diamond abrasive grits is used to level the polishing pad.

The conditioner used for the CMP process differs from a conventional diamond tool used for cutting and grinding in essentially the following aspect. With cutting tools there is no loss of cutting power even if some shedding of the diamond abrasive grits occurs, so long as other diamonds are left on the new surface after the diamond shedding, whereas with a CMP conditioner, the shedded diamond abrasive grits damage the polishing pad or semiconductor substrate surface, and therefore diamond shedding is unacceptable even in small amounts. In addition, since wet systems are employed at a low rotation rate, there is no need for the heat resistance or high abrasion resistance demanded for cutting tools. Conventional diamond tools for which shedding of the diamond abrasive grits is a problem include diamond bits wherein single-grain, relatively large diamonds are bonded in a metal supporting material. However, these are essentially different from conditioners used in CMP processes in the following aspect. With conventional diamond bits, relatively large diamonds (generally with a diameter of about 1 mm or greater) are bonded as single grains, whereas conditioners used for CMP processes have relatively small (50–300 $\mu$m diameter) diamonds bonded in a sheet-like manner in a single layer.

Conventional conditioning of a polishing pad has employed a conditioning method which uses a grinding stone having nickel electrodeposited diamond grains. Nickel electrodeposition has become widely used because it can be applied relatively easily to metal supporting materials. However, nickel is readily corroded by acid. Consequently, when nickel electrodeposited conditioners are employed for conditioning when using acidic slurry, corrosion of the nickel occurs because of the acidic slurry. As a result, the usable life of the conditioner is considerably shortened, scratch damage due to shedding of the diamond grains occurs within a shorter time, and the polishing speed is reduced because of deteriorating conditioning performance. For this reason there has been a demand for diamond conditioners with high durability against acidic slurry.

DISCLOSURE OF THE INVENTION

It is therefore an object of the present invention to provide a conditioner with particularly high durability against acidic slurry for conditioning of a polishing pad.

The conditioner of the present invention is a conditioner for a polishing pad used for flat polishing processes for semiconductor substrates, characterized in that diamond grains are supported by monolayer brazing in/on a supporting material comprising a metal and/or alloy, using an alloy with a melting point of 600–1200° C., the alloy containing 0.5–20 wt % of at least one metal selected from the group consisting of titanium, zirconium and chromium and 30–99.5 wt % of at least one metal selected from the group consisting of gold, platinum and silver.

BEST MODE FOR CARRYING OUT THE INVENTION

The conditioner of the present invention is a conditioner for a polishing pad used for flat polishing processes for semiconductor substrates, characterized in that diamond grains are supported by monolayer brazing in a supporting material comprising a metal and/or alloy, using an alloy with a melting point of 600–1200° C. which contains 0.5–20 wt % of at least one metal selected from the group consisting of titanium, zirconium and chromium and 30–99.5 wt % of at least one metal selected from the group consisting of gold, platinum and silver.

According to a preferred mode of the present invention, the alloy with a melting point of 600–1200° C. in the conditioner has a highly acid-resistant thin film on its surface for the purpose of further enhancing the durability against the afore-mentioned acidic slurry. Here, the highly acid-resistant thin film is preferably a film made of an organic material, and is more preferably a film made of a fluorine resin. Besides, the highly acid-resistant thin film may also be a film comprising at least one metal selected from the group consisting of gold, gold alloy, platinum, platinum alloy, rhodium and rhodium alloy. Films made of organic materials generally have excellent acid resistance, and in particular films made of fluorine resins have very satisfactory acid resistance. Films comprising at least one metal selected from the group consisting of gold, gold alloy, platinum, platinum alloy, rhodium and rhodium alloy have excellent acid resistance as well as satisfactory adhesion with the alloy having a melting point of 600–1200° C. in the conditioner. Thus, by forming a film made of organic materials or a film comprising at least one metal selected from the group consisting of gold, gold alloy, platinum, platinum alloy, rhodium and rhodium alloy on the surface of the alloy with a melting point of 600–1200° C. in the conditioner, it is possible to achieve improvement in the acid resistance of the conditioner and a longer usable life for the conditioner.

According to the present invention, the diamond grains preferably have a size of 50 μm to 300 μm, and the thickness of the thin film formed on the surface of the alloy of the conditioner is preferably from 0.1 μm to 100 μm.

As publicly disclosed technology in the same technical field of the invention, there is disclosed in Japanese Patent Laid-Open Publication No. 10-12579 a conditioner for a polishing pad for semiconductor substrates having diamond grains supported by brazing in a supporting material using an alloy with a melting point of 700–1100° C. containing at least one metal selected from the group consisting of gold, silver, copper and titanium. However, Japanese Patent Laid-Open Publication No. 10-12579 is a technique aimed at preventing shedding of the diamond grains, whereas the present invention is a technique aimed at improving the durability against acidic slurry. Furthermore, Japanese Patent Laid-Open Publication No. 10-12579 does not mention the structural composition of the alloy. The present inventors have found, unexpectedly, that including at least 30 wt % of at least one noble metal such as gold, platinum or silver in the alloy is highly effective for improving the acid resistance of the alloy. In other words, the present invention provides an unexpected effect that is not disclosed in Japanese Patent Laid-Open Publication No. 10-12579.

In addition, Japanese Patent Laid-Open Publication No. 10-175156 discloses a conditioner for a polishing pad for semiconductor substrates having diamond grains supported by brazing in a supporting material using an alloy with a melting point of 650–1200° C. containing 0.5–20 wt % of at least one metal selected from among titanium, zirconium and chromium. Like Japanese Patent Laid-Open Publication No. 10-12579, however, Japanese Patent Laid-Open Publication No. 10-175156 is also a technique aimed at preventing shedding of the diamond grains, whereas the present invention is a technique aimed at improving the durability particularly against acidic slurry. Furthermore, Japanese Patent Laid-Open Publication No. 10-175156 does not mention the structural composition of any alloys other than the alloy containing at least one metal selected from the group consisting of titanium, zirconium and chromium in the amount of 0.5–20 wt %. According to the present invention, it has been shown that including at least 30 wt % of at least one rare metal such as gold, platinum or silver in the alloy is highly effective for improving the acid resistance of the alloy. In other words, the present invention provides a special effect that is not disclosed in Japanese Patent Laid-Open Publication No. 10-175156.

Because the conditioner for a polishing pad of semiconductor substrates according to the present invention has enhanced durability against acidic slurry, it has a longer usable life and makes it possible to minimize polishing speed reduction and scratch damage due to shedding of the diamond grains. As a result, higher working precision becomes possible, as well as lower cost for production of semiconductor substrates and semiconductors at high yields.

The present inventors have found, unexpectedly, that including at least 30 wt % of at least one metal selected from the group consisting of gold, platinum and silver in the alloy used for bonding of the diamond grains improves the acid resistance with respect to acidic solutions, while having no adverse effects on the other properties.

On the other hand, for bonding between the diamond and the brazing alloy, the bonding strength is notably improved by forming a layer made of titanium carbide, zirconium carbide, chromium carbide or the like at the interface between the two. The present inventors have confirmed that by using a brazing alloy containing at least one metal selected from the group consisting of titanium, zirconium and chromium there is formed a metal carbide layer at the interface between the diamond and the brazing alloy. In order to form the metal carbide layer at the interface, it is necessary for the brazing alloy to contain at least 0.5 wt % of at least one metal selected from among titanium, zirconium, chromium, etc. Because a sufficient effect of improved bonding strength due to formation of the metal carbide layer at the interface can be achieved if the content of the titanium, zirconium, chromium, etc. is 20 wt %, the upper limit thereof is 20 wt %.

The brazing alloy is an alloy with a melting point of 600–1200° C. because if a brazing temperature is below 600° C. sufficient bonding strength is not obtained, while a brazing temperature above 1200° C. is not preferred because it leads to deterioration of the diamond. The thickness of the brazing alloy is suitable at a thickness which is 0.2–1.5 times the size of the diamond grains. If it is too thin the bonding strength between the diamond and the brazing alloy will be too low, and if it is too thick, peeling will tend to occur between the brazing material and the supporting material, which is undesirable.

The size of the diamond grains is preferably from 50 μm to 300 μm. A diamond size of less than 50 μm does not give an adequate polishing speed, while an adequate polishing speed is achieved with 300 μm. Also, diamond with fine grains of less than 50 μm tend to aggregate together, and when the aggregation forms clusters these will tend to shed off, causing scratch damage. Diamond with coarse grains having a greater size than 300 μm undergoes larger stress concentration during polishing, becoming prone to shedding.

The thickness of the highly acid-resistant thin film formed on the surface of the alloy metal of the conditioner is preferably from 0.1 μm to 100 μm. A thin film of less than 0.1 μm will not give an adequate effect of improved acid resistance, while a thickness of 100 μm is sufficient to give an effect of improved acid resistance.

EXAMPLES

An alloy with a melting point of 820° C. containing 70 wt % silver and 2 wt % titanium was used with diamond grains having a mean grain size of 150 μm, for brazing of the diamond onto a stainless steel supporting base at a vacuum of $10^{-5}$ Torr at 880° C. Four conditioners were fabricated, and on three of them there were formed thin films on the surfaces of the bonding alloys. Specifically, a fluorine resin coating was formed on one, a gold coating on another, and a rhodium coating on the third.

These four conditioners according to the present invention (brazed, brazed+fluorine resin thin film, brazed+gold thin film and brazed+rhodium thin film) and a conventional Ni-electrodeposited conditioner as a comparative example were used for a polishing test on silicon wafers each having a tungsten thin film formed on the surface thereof by CVD. The number of wafers polished was 400 per conditioner. The slurry used was an iron nitrate/nitric acid-based slurry with a pH of 1.5 and alumina as the abrasive grits. The polishing time was 2 minutes, and conditioning was carried out once for each polishing, for 2 minutes each time. The polishing speed was measured every 50 wafers up to the 100 wafers, and then every 100 wafers thereafter. The results are shown in Table 1. With the conventional conditioner used as the comparative example, the conditioning performance deteriorated notably, and the polishing speed began to fall after polishing the 50th wafer, resulting in a notable reduction in polishing speed so that the experiment was discontinued after polishing the 100th wafer. On the other hand, with the four types of conditioners of the present invention used as examples, no reduction in polishing speed was seen even after polishing the 400th wafer. Consequently, the conditioners of the present invention exhibited significantly improved durability against acidic slurry compared to the conventional conditioner.

As the results of these examples clearly demonstrate, the present invention provides conditioners with significantly improved durability against acidic slurry. By using a conditioner according to the present invention, the usable life of the conditioner is lengthened to allow effective cost reduction, while there is no need to frequently replace the conditioner and therefore throughput is improved and further cost reduction is possible.

TABLE 1

| Type of conditioner | Comp. Ex. 1 Ni electro-deposition | Example 1 Brazing | Example 2 Brazing + fluorine resin thin film | Example 3 Brazing + gold thin film | Example 4 Brazing + rhodium thin film |
|---|---|---|---|---|---|
| Polishing speed at 1st wafer nm/min | 252 | 251 | 255 | 256 | 255 |
| Polishing speed at 50th wafer nm/min | 192 | 253 | 259 | 255 | 257 |
| Polishing speed at 100th wafer nm/min | 116 | 248 | 254 | 250 | 262 |
| Polishing speed at 200th wafer nm/min | — | 246 | 257 | 259 | 258 |

TABLE 1-continued

| Type of conditioner | Comp. Ex. 1 Ni electro-deposition | Example 1 Brazing | Example 2 Brazing + fluorine resin thin film | Example 3 Brazing + gold thin film | Example 4 Brazing + rhodium thin film |
|---|---|---|---|---|---|
| Polishing speed at 300th wafer nm/min | — | 242 | 268 | 257 | 253 |
| Polishing speed at 400th wafer nm/min | — | 241 | 261 | 260 | 259 |

What is claimed is:

1. A conditioner for a polishing pad used for flat polishing processes for semiconductor substrates, wherein diamond grains are supported by monolayer brazing in/on a supporting material comprising a metal and/or alloy, using an alloy with a melting point of 600–1200° C. which consists essentially of 0.5–20% by weight of at least one metal selected from the group consisting of titanium, zirconium and chromium and 30–99.5% by weight of at least one metal selected from the group consisting of gold, platinum and silver, said alloy with the melting point of 600–1200° C. having an improved corrosion resistance compared to nickel electrodeposition with respect to an acidic slurry.

2. A conditioner according to claim 1, wherein said alloy with the melting point of 600–1200° C. has a highly acid-resistant thin film on a surface thereof.

3. A conditioner according to claim 2, wherein said thin film is a film made of an organic material.

4. A conditioner according to claim 3, wherein said film made of the organic material is a film made of a fluorine resin.

5. A conditioner according to claim 2, wherein said thin film is a film comprising at least one metal selected from the group consisting of gold, gold alloy, platinum, platinum alloy, rhodium and rhodium alloy.

* * * * *